United States Patent [19]

Brent

[11] 4,292,503

[45] Sep. 29, 1981

[54] SPLIT-BAND ELECTRIC HEATER

[75] Inventor: Richard W. Brent, Pittsburgh, Pa.

[73] Assignee: Emerson Electric Co., St. Louis, Mo.

[21] Appl. No.: 38,402

[22] Filed: May 14, 1979

[51] Int. Cl.[3] ..... H05B 3/58

[52] U.S. Cl. ..... 219/535; 29/611; 29/613; 219/301; 219/311; 219/536; 219/549; 338/210; 338/249; 338/251

[58] Field of Search ..... 219/311, 535, 548, 549, 219/536, 537, 539, 301; 338/210, 249, 247, 248, 251; 29/611, 613

[56] References Cited

U.S. PATENT DOCUMENTS

| | | | |
|---|---|---|---|
| 1,614,330 | 1/1927 | Wiegand | 338/240 |
| 1,864,666 | 6/1932 | Osborne | 219/535 X |
| 2,817,742 | 12/1957 | Drugmand | 219/549 |
| 2,875,312 | 2/1959 | Norton | 219/535 |
| 3,158,363 | 11/1964 | Breckenridge | 432/36 |
| 3,475,597 | 10/1969 | Desloge | 219/535 |
| 3,619,566 | 6/1970 | Finch | 219/535 |
| 3,730,373 | 5/1973 | Kozbelt | 219/535 |
| 4,074,402 | 2/1978 | Taketani | 24/268 |
| 4,109,350 | 8/1978 | Acre | 24/249 |

FOREIGN PATENT DOCUMENTS

| | | | |
|---|---|---|---|
| 286767 | 4/1914 | Fed. Rep. of Germany | 219/535 |
| 2338732 | 2/1975 | Fed. Rep. of Germany | 219/535 |
| 2511137 | 9/1976 | Fed. Rep. of Germany | 219/535 |

*Primary Examiner*—A. Bartis

*Attorney, Agent, or Firm*—Michael Williams

[57] ABSTRACT

A split-band heater adapted to encompass a cylindrical object for heating the same. The heater has tensioning means at the split for drawing the heater against a transverse peripheral surface of the object. The heater comprises two or more arcuate-shaped metal-sheathed heater sections, each in the form of a strip heater, each section being adapted for positionment along a respective portion of the transverse peripheral surface of the object.

Each strip heater comprises an elongated metal channel having a planar base wall and a pair of coextensive side walls extending in the same direction from the edges of the base wall, the channel containing a resistance wire and electrical insulation means therefor, both disposed lengthwise within the channel, and an elongated metal strip fits transversely within the channel. The side walls of the channel are bent over adjoining longitudinal margins of the metal strip to lock it and the resistance wire and insulation means within the channel. Each strip heater is arcuately bent so that its base wall is located innermost of the arc and adapted to fit along the curved transverse outer surface of the cylindrical object. The strip heaters are arranged in spaced-apart, end-to-end relationship as longitudinal continuations. A juxtaposed pair of spaced strip heater ends defining the split have the tensioning means connected thereto, the remaining juxtaposed pair of spaced ends being connected together by the flexible metal band which may be fixed thereto to become a part thereof, or may be an integral continuation of the base walls of the heater sections.

4 Claims, 8 Drawing Figures

FIG. 1.
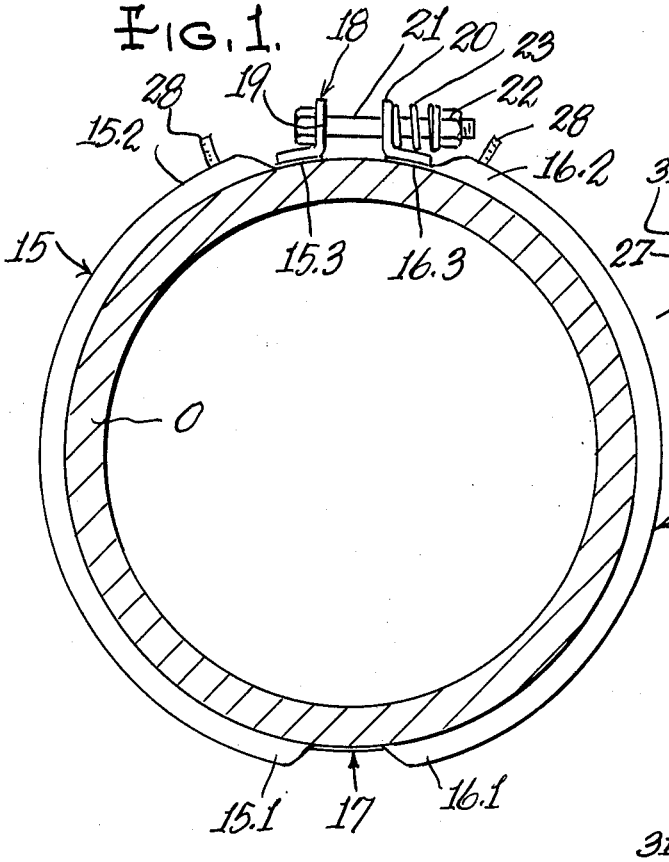
FIG. 3.
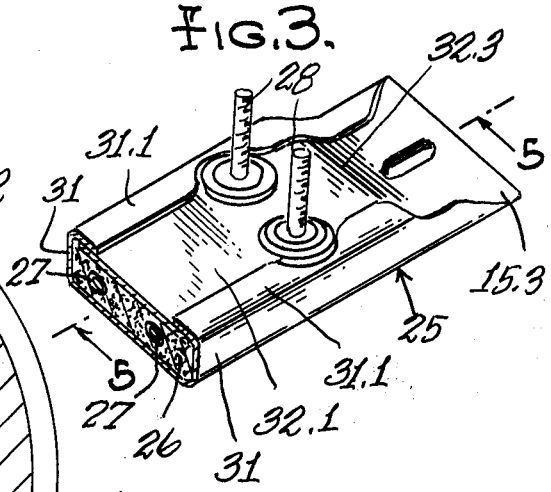
FIG. 4.
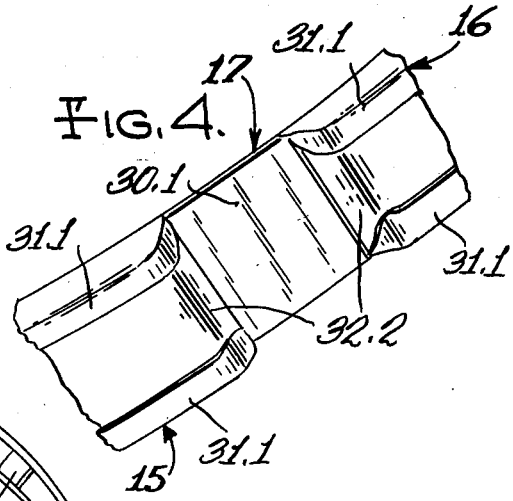
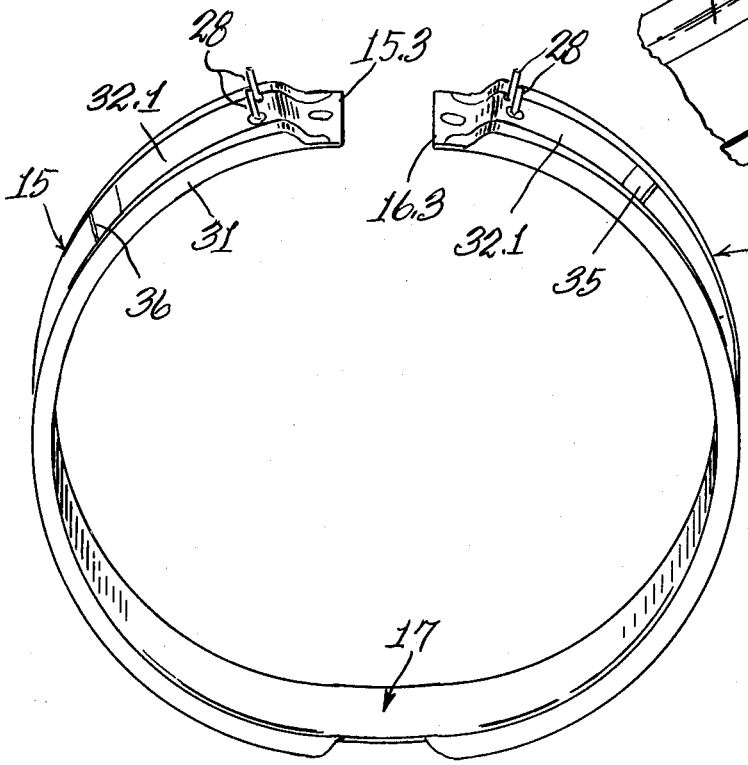
FIG. 2.

SPLIT-BAND ELECTRIC HEATER

BACKGROUND AND SUMMARY

Split-band heaters are well known in the prior art, and are used for many purposes, such as heating fluids within a tank, heating extruding nozzles of plastic injection apparatus, and many other uses. An early form of a split-band heater is shown in U.S. Pat. No. 1,614,330, issued to Edwin L. Wiegand, in which the heating resistor was embedded in compacted refractory material. The heater was manufactured as a rectilinear strip heater and subsequently formed to band shape. The split in this type of heater could be opened only a small amount because otherwise the compacted refractory material would develop cracks which result in hot spots in the heater and ultimate failure thereof. Therefore, this type of heater was largely confined to an assembly wherein the band could be slipped over an end of a cylindrical object.

Flexible strip heaters, such as shown in U.S. Pat. No. 2,817,742, issued to L. D. Drugmand were developed for the purpose of encircling a water tank, the rectilinear heater being insertable into a closed channel formed around the tank wall and the heater flexing to conform to the annular channel. In this case, mica was used as the insulating medium and this limited the heater to a relatively low heat. Further, because the design of the heater required flexibility, the channel in which the resistor and mica were disposed had a series of longitudinally-disposed slits through which moisture could enter.

A further development in the art is reflected in U.S. Pat. No. 3,730,373, issued to L. S. Kozbelt wherein two strip heaters, each of arcuate formation, were held around the wall of a cylindrical object by means of a separate clamping band. Although satisfactory in use, the cost of the clamping band, usually of stainless steel, was a disadvantage.

U.S. Pat. No. 3,619,566, issued to T. E. Finch, also discloses a development in the art. This patent eliminates the need for a separate clamping band, and enables the heater to be assembled transversely of a cylindrical object. The strip heaters in this patent had their opposite ends formed with hooks, the hooks at one pair of adjoining ends providing connection for a tensioning device and the hooks at the other pair of adjoining ends providing connection for an axially-slotted tubular spring member. However, reflexing the ends of the strip heaters is not an easy operation. Further, because the tensioning means, the two arcuate heaters and the tubular spring member are separate parts, it was difficult for one man to assemble the heater on a tubular object, especially the extruding barrel or nozzle of an injection molding machine.

My invention overcomes the disadvantages of the prior art, as above noted, and provides a low-cost split-band heater that is easily assembled around a cylindrical object by only one workman. My improved heater comprises two or more arcuately-shaped metal-sheathed heater sections, and hinge means between the sections and fixed thereto to become a part thereof, the hinge means enabling the heater sections to be sprung apart enough so that the heater may be positioned around a cylindrical object by movement transversely of the latter.

Each strip heater comprises an elongated metal channel having a planar base wall and a pair of coextensive sidewalls extending in the same direction from the edges of the base wall, the channel containing a resistance wire and electrical insulation means therefor, both disposed lengthwise within the channel. Each strip heater is arcuately bent so that its base wall is located innermost of the arc and adapted to fit along the curved transverse outer surface of the cylindrical object. The strip heaters are arranged in end-to-end relationship as longitudinal continuations.

A juxtaposed pair of spaced strip heater ends defining the split have the tensioning means connected thereto, the remaining juxtaposed pair of spaced ends being connected together by the flexible metal band. In one aspect of the invention, the heater sections share a common channel, with the sections spaced along the channel whereby in completed form the base wall of the channel provides a flexible strip between the heater sections to provide the hinge means.

DESCRIPTION OF THE DRAWINGS

In the drawings accompanying this specification and forming a part of this application, there are shown, for purpose of illustration, embodiments which my invention may assume, and in these drawings:

FIG. 1 is an end view of a preferred embodiment of my improved heater, showing the latter in position around a cylindrical object, FIG. 2 is a perspective view of the heater shown in FIG. 1 removed from the object and without tensioning means, FIG. 3 is a fragmentary perspective view of one end of the heater, FIG. 4 is a fragmentary perspective view of an intermediate portion of the heater.

DESCRIPTION OF THE PREFERRED EMBODIMENT

Figures 5, 6, 7, 8:
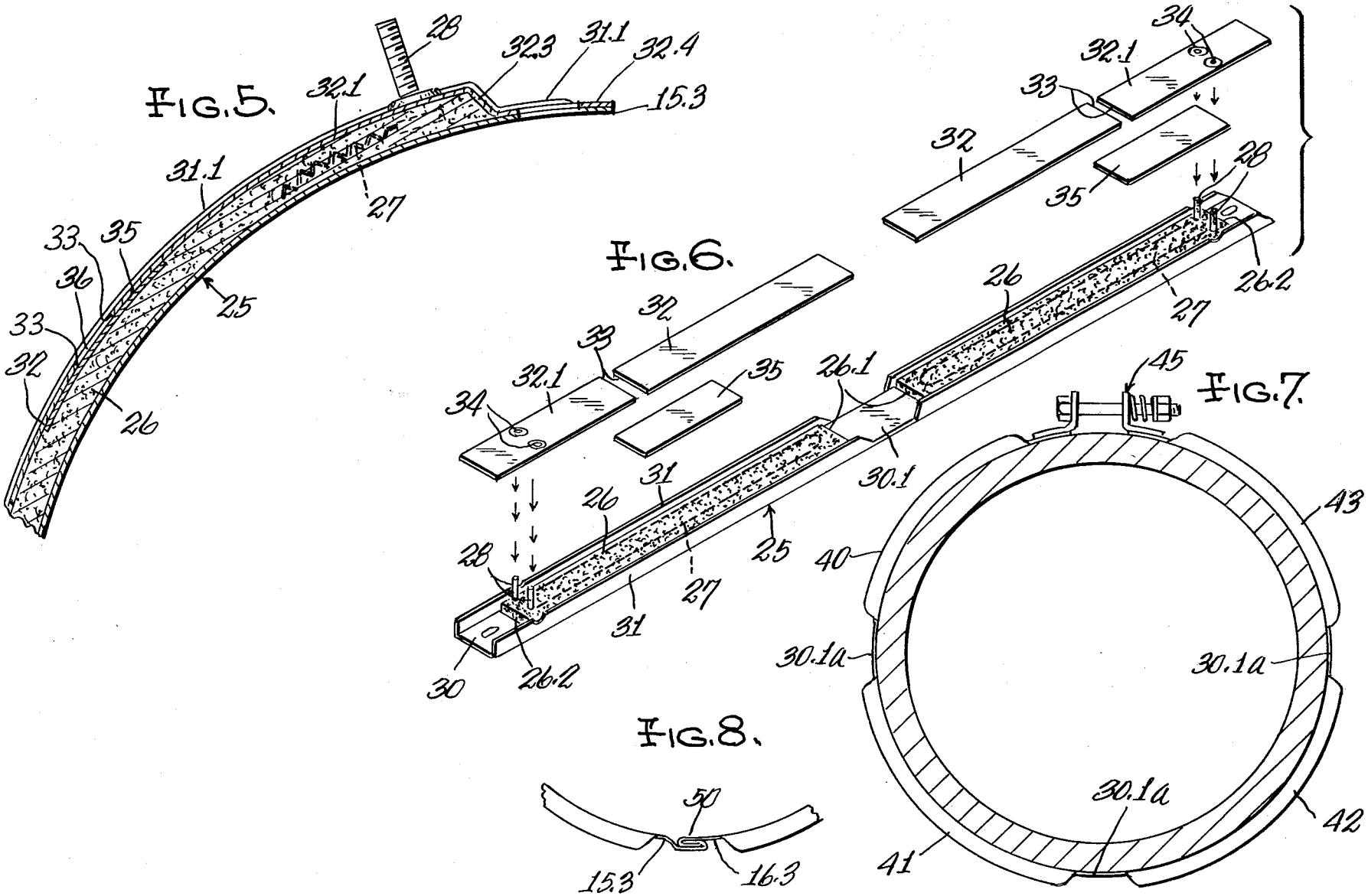
FIG. 5 is a fragmentary longitudinal sectional view, corresponding to the line 5—5 of FIG. 3.
FIG. 6 is a separated perspective view of parts of the structure shown in FIG. 2, prior to assembly.
FIG. 7 is a view similar to FIG. 1, but showing another embodiment of my invention.
FIG. 8 is a fragmentary elevational view of a further embodiment of my invention.

As seen in FIG. 1, my improved heater is shown clamped around a circular object O which may be the extrusion barrel or nozzle of a plastic injection machine, or a water tank, or any other object to be heated. The heater comprises two arcuately-shaped metal-sheathed strip heater sections, 15 and 16, having one set of ends 15.1 and 16.1 in spaced relation and joined by a flexible metal band 17. The opposite ends 15.2 and 16.2 of the sections have tabs 15.3 and 16.3 to which tensioning means 18 are connected.

Any well-known type of tensioning means may be utilized in connection with the heater, and in the embodiment shown in FIG. 1, angle brackets 19 and 20 are connected to respective tabs 15.3 and 16.3 in any suitable manner, such as by welding. The brackets have aligned openings to pass a bolt 21, the head of the bolt bearing against the bracket 19 and a nut 22 is threaded on the bolt to pull the heater tightly against the transverse periphery of the object O. In some cases, a coil spring 23 is interposed between the nut 22 and the bracket 20 to maintain tension on the heater even when the object contracts upon cooling, and to prevent the connection from breaking when the object expands when heated.

To remove the heater from the object, the nut 22 and coil spring 23 are removed from the bolt 21, and the latter is removed from the brackets 19, 20. The heater sections may then be sprung apart about the band 17, sufficiently to clear the object and the heater may be withdrawn from the object by bodily transverse movement. The heater may be assembled with the object by a reversal of these steps.

My improved heater may be manufactured by operations not entirely different than disclosed in the Wiegand U.S. Pat. No. 1,614,330, above-mentioned, or in a more automated operation disclosed in U.S. Pat. No. 3,696,507, issued to Robert W. Unger et al.

As shown in FIG. 6, an elongated channel 25 has a pair of refractory cakes 26, 26 disposed therein. Each of the cakes has a resistance conductor 27 embedded therein and terminal screws 28 extend from one end of each of the cakes, although in some cases the terminal screws may be at opposite ends of each cake, or both at the inner ends of the cakes. Each cake is a compacted mass of refractory material and may be formed within the channel 25, or may be formed separately and thereafter placed into the channel. It will be appreciated that mica, or other suitable insulating material, may be used instead of the refractory material.

As seen in FIG. 6, the channel comprises a planar base wall 30 and spaced side walls 31, 31, extending in the same direction from the edges of the base wall. The ends of the channel correspond to prior art structure but the center of the channel differs in that the side walls are removed at the zone corresponding to the space between adjoining ends of the cakes, leaving only a base wall portion 30.1. The side walls 31 may be turned over the cakes 26, but preferably a cover plate is first disposed over the cakes. It is preferred to make each cover plate in sections 32 and 32.1 which abut at end edges 33 upon initial assembly. The sections 32.1 are formed with apertures 34 to pass the terminal screws 28, with insulating washers in the apertures to electrically insulate the screws from the cover plate. At the split 33 of the cover plates, sub-plates 35 are disposed over the cakes.

The upper portion of the sidewalls 31 are then turned over the cover plates in conventional manner to the form shown in FIGS. 3 through 5. The cakes 26, 26 are fully enclosed by the channel and the cover plates, since the cover plates 32, 32 extend over the inwardly-directed ends 26.1, 26.1 of the cakes, as seen at 32.2 in FIG. 4, and are locked in position by side wall portions 31.1. The cover plates 32.1 extend over the outwardly directed ends 26.2 of the cakes, as seen at 32.3 in FIGS. 3 and 5 and overlie the adjoining ends of the channel, as seen at 32.4 to form a substantial end tab 15.3 for supporting the tensioning brackets 19, 20. The cover plate portions 32.3 and 32.4 are locked in position by the turned-over sidewall portions 31.1.

The two strip heaters thus formed are bent to an arcuate shape so that each has its base wall curved and located innermost of the arc whereby the base wall is adapted to be disposed in engagement with the outer peripheral surface of the object O. The base wall portion 30.1 between the strip heaters is free of the stiffening effect of the side walls and provides a flat flexible band which is also adapted to be curved to engage and lie along the outer peripheral surface of the object O. Since the base wall of the arcuate heater is innermost of the arc, the cover plates 32 and 32.1 are outermost of the arc. Bending of the strip heaters causes the end edges 33 of the cover plates 32, 32.1 to spread apart, as seen at 36 in FIG. 5, but the sub-plates 35 cooperate with the plates 32, 32.1 to form lapping longitudinal sections which cover the opening thus formed and compensate for length increase when the strip heaters are bent to curved shape. All that is now necessary is to connect the tenioning means brackets 19 and 20 to respective tabs 15.3, 16.3 of the strip heaters, and split-band heater is ready for use.

DESCRIPTION OF OTHER EMBODIMENTS

More than two strip heater sections may be formed in the manner heretofore described, with slight variations. As seen in FIG. 7, four strip-heater sections 40, 41, 42 and 43 are formed, with base wall strips **30.1*a* (like strip 30.1) between sections 40 and 41, 41 and 42, and 42 and 43. It will be appreciated that the base wall strip 30.1*a* will be formed as a result of interruption of the side walls of a channel, as shown in FIG. 6. Tensioning means 45 of any suitable type (such for example like the means 18 of FIG. 1) are applied to adjoining ends of the heater sections 40, 43**, and the split band heater is ready for use.

In FIG. 8 each of the heater sections have both ends formed like that shown in FIG. 3, with the tabs 15.3, 16.3 slightly longer so that they may be firmly interlocked, as shown at 50. Although this is not the presently-preferred embodiment, it is disclosed to show that the flexible connection between adjoining ends of the strip heaters may be in the form of a structurally integral member.

I claim:

1. The method of making a split-band electric heater adapted to be drawn tightly around the transverse outer peripheral surface of a cylindrical object to heat the same, said method comprising the use of an elongated metal channel having a planar base wall and coextensive side walls extending in the same direction from opposite longitudinal edges of said base wall, said legs being removed in a zone intermediate the ends of said channel to leave thereat a portion of said base wall free of the stiffening effect of said legs, providing at least two elongated heater portions in end-to-end relation within said channel, each heater portion comprising a resistance conductor and insulating material for electrically insulating said conductor from said channel, adjoining ends of said heater portions being spaced apart in said channel substantially the extent of said zone, turning the free margins of said side walls inwardly and over said heater portions to lock the same in position within said channel, and bending said channel at said locked-in heater portions to provide facing arcuately-shaped heater sections with the base wall at said sections disposed inwardly of the arc and adapted to be disposed in engagement with the outer peripheral surface of the cylindrical object.

2. In a split band heater adapted to encompass the outer periphery of a cylindrical object for heating the same, said heater having disconnectable tensioning means at the split thereof, said tensioning means when connected and tensioned being adapted to draw said split-band heater tightly around and against a transverse outer peripheral surface of the object, the improvement wherein said split-band heater comprises:

at least two arcuately-shaped metal-sheathed strip heaters, each for positionment along a respective portion of the transverse outer peripheral surface of the object, each strip heater comprising an elongated metal channel having a planar base wall and a pair of coextensive side walls extending in the same direction from the edges of said base wall, said channel containing a resistance wire and electrical insulation means therefor, both disposed lengthwise of and within said channel and an elongated metal strip substantially equal to the length of said channel and fitting transversely within said channel and in spanning relation with respect to said side walls, the latter being bent over adjoining longitudinal margins of said strip to lock said resistance wire and insulation means within said channel, each strip heater being arcuately bent so that its base wall is curved and located innermost of the arc so as to be adapted to closely fit along and against the curved transverse outer surface of the cylindrical object, said strip heaters being arranged in spaced-apart, end-to-end relationship as longitudinal continuations to transversely fit along a substantial portion of the outer peripheral surface of the cylindrical object, a juxtaposed pair of spaced strip heater ends defining said split and said tensioning means being connected thereto, the remaining juxtaposed pairs of spaced ends each being connected together by a flexible metal band which forms a structurally integral continuation of the base walls of the so-connected strip heaters so as to also lie close to the juxtaposed outer surface of the cylindrical object without any substantial space between, the flexibility of the band enabling said strip heaters to be moved apart, when said tensioning means are disconnected to open said split enough so that the heaters may be moved in a direction transverse to the longitudinal axis of the object to a position around the object, and the flexibility of the band further permitting the base walls of said strip heaters to be drawn against the transverse peripheral wall of the object to closely conform said walls and the band to the curvature of the object by the connected and tensioned tensioning means.

3. The heater structure according to claim 2 wherein said elongated metal strip of each strip heater is located outermost of the arc of the curved strip heater and is formed in lapping longitudinal sections to compensate for length increase when said strip heaters are bent to curved shape.

4. In a split-band electric heater adapted to encompass the outer periphery of a cylindrical object for heating the same, said heater having disconnectable tensioning means at the split thereof, said tensioning means when connected and tensioned being adapted to draw said split-band heater around and tightly against a transverse peripheral outer surface of the object, the improvement wherein said split-band heater comprises:

an arcuately-shaped, metal-sheathed heater for positionment along a respective portion of the transverse outer peripheral surface of the object, said heater comprising an elongated metal channel having a planar base wall and coextensive side walls extending in the same direction from opposite longitudinal edges of said base wall, said heater being arcuately bent so that its base wall is curved and located innermost of the arc so that said base wall is adapted to be disposed in engagement with the outer peripheral surface of said object, and at least two elongated heater portions of combined length less than that of said channel and disposed within the same in end-to-end relation but with space between adjoining ends of each juxtaposed pair of heater portions, each heater portion comprising a resistance conductor and insulating means for electrically insulating the conductor from said channel, said opposite legs of said channel being bent over said heater portions to lock the same in position within said channel, said channel opposite side walls being removed at each zone corresponding to said space between said adjoining heater portion ends to leave thereat an integral portion of said base wall free of the stiffening effect of said side walls and providing a flexible metal band member thereat which is adapted to be curved to engage and lie along the outer peripheral surface of said object, said split being defined by opposite ends of said channel and said tensioning means being adapted to be connected to said opposite ends, the flexibility of said band member at each zone permitting said tensioning means to draw said base wall around the object and to conform said wall and said band member at each zone to the curvature of the transverse outer peripheral surface of said object.

* * * * *